US006272940B1

(12) United States Patent
Tsunoda et al.

(10) Patent No.: US 6,272,940 B1
(45) Date of Patent: Aug. 14, 2001

(54) STARTING DEVICE FOR ELECTRIC STARTER MOTOR

(75) Inventors: Shuhei Tsunoda; Mitsuo Osakabe, both of Gunma Prefecture (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 09/314,145

(22) Filed: May 19, 1999

(30) Foreign Application Priority Data

May 20, 1998 (JP) ..... 10-155290

(51) Int. Cl.[7] ..... F02N 00/00
(52) U.S. Cl. ..... 74/7 C; 192/41 R
(58) Field of Search ..... 74/7 C, 7 A, 7 D, 74/7 E, 7 R; 192/41 R

(56) References Cited

U.S. PATENT DOCUMENTS 4,433,769 * 2/1984 Scuccato et al. ..... 192/98
4,662,233 * 5/1987 Mazzorana ..... 74/7 A
4,684,816 * 8/1987 Mazzorana ..... 290/38 R
5,513,607 * 5/1996 Doragrip et al. ..... 123/185.3
5,676,103 * 10/1997 Tsunoda et al. ..... 123/185.3

FOREIGN PATENT DOCUMENTS 2-574483 * 6/1986 (FR) .
61-112774 * 5/1986 (JP) .

* cited by examiner

*Primary Examiner*—Sherry Estremsky
*Assistant Examiner*—Tisha D. Lewis
(74) *Attorney, Agent, or Firm*—Breiner & Breiner, L.L.C.

(57) ABSTRACT

A starting device for an electric starter motor is described which is capable of downsizing a small-sized motor per se without increasing torque of the small-sized motor by deceleration by gears, is capable of being fabricated in a small size as a whole and inexpensively, and is capable of setting a reduction gear having desired dimensions without significantly changing sizes in a radial direction and in an axial direction of total of a starter case. The starting device for an electric starter motor includes a ring gear driven by two or more small-sized motors and a clutch mechanism installed between the ring gear and an engine for starting the engine by rotating the ring gear. Featured in the starting device for an electric starter motor is a reduction gear which is interposed between the small-sized motors and the ring gear. The reduction gear is arranged on an outer side of the ring gear.

7 Claims, 5 Drawing Sheets

STARTING DEVICE FOR ELECTRIC STARTER MOTOR

BACKGROUND OF THE INVENTION

1. Field of the Invention

The present invention relates to a starting device for an electric starter motor (self starter motor) which is used as an apparatus of starting an engine, particularly, a small-sized engine.

2. Description of the Related Art

Conventionally, there has widely been known a self-motor of this kind illustrated in FIG. 19 of JP-A-2-108855. According to the self-motor disclosed in the publication, a fly wheel integrally formed with a cooing fan is attached to a crank shaft projected from an engine main body. A ring gear is attached to the outer periphery of the fly wheel. A starter motor having a length the same as a width of the engine main body is attached to a side face portion of the engine main body. A drive gear is fixed to an outer peripheral face of a drive shaft projected from the starter motor. Further, when the starter motor is driven, the drive shaft is projected out and the drive gear is brought in mesh with the ring gear to thereby rotate the crank shaft via the fly wheel. A clutch structure is constituted such that when the engine is brought into a started state in this way, the drive shaft of the starter motor is drawn to an original state and the engagement of the drive gear with the ring gear is disengaged.

As described above, according to the conventional self-motor, the engine needs to start by bringing the drive gear in mesh with the ring gear installed at the outer periphery of the fly wheel having a large diameter. Therefore, a starter motor of a style which is large-sized and is provided with large drive force is obliged to use and its fabrication cost is expensive. Further, there is constructed the constitution in which the drive gear of the drive shaft is brought in mesh with the ring gear installed at the outer periphery of the fly wheel. Therefore, there causes an inconvenience in which a dimension of a total of the engine in the diameter direction is significantly magnified since the starter motor is arranged to attach to the side face portion of the engine main body.

In order to resolve such an inconvenience, the applicant has proposed a starting device for an electric starter motor comprising a ring gear driven by two or more of small-sized motors and a clutch mechanism installed between the ring gear and an engine for starting the engine by rotating the ring gear in Japanese Patent Application No. 73381/1998.

Although the proposed starting device for an electric starter motor is effective in resolving the above-described inconvenience, there is constructed a constitution in which pairs of ring gears and motor side gears are brought in mesh with each other in parallel and accordingly, the diameter of the ring gear is obliged to magnify. Accordingly, a total of the engine integrated with the starting device cannot be expected to downsize significantly and the torque of the small-sized motor needs to increase.

Further, even when a reduction gear is interposed therebetween such that large torque is not needed in the small-sized motor, a large-sized reduction gear cannot be arranged since dimensions in a radial direction and an axial direction are restricted in view of an attachment pitch of a starter case, incorporated parts and so on.

SUMMARY OF THE INVENTION

It is an object of the invention to resolve the problem of the conventional technology and to provide a starting device for an electric starter motor capable of downsizing a small-sized motor per se without increasing torque of the small-sized motor by deceleration by gears, capable of being fabricated in a small size as a whole and inexpensively and capable of setting a reduction gear having desired dimensions without significantly changing sizes in a radial direction and in an axial direction of a total of a starter case.

In order to achieve the above-described object, according to the invention, there is provided a starting device for an electric starter motor comprising a ring gear driven by two or more of small-sized motors and a clutch mechanism installed between the ring gear and an engine for starting the engine by rotating the ring gear, wherein a reduction gear is interposed between the small-sized motors and the ring gear. Further, the reduction gear is arranged on an outer side of the ring gear.

In this way, according to the invention, the plurality of small-sized motors for the starter and the engine are operationally coupled by the ring gear and the clutch mechanism and the reduction gear is interposed between the small-sized motors and the ring gear. Therefore, the constitution is extremely simplified. Further, the plurality of small-sized motors for the starter are used and rotation of the small-sized motors is transmitted to the ring gear by the interposed reduction gear. Therefore, the torque of the small-sized motor can be set small, the used small-sized motor can be downsized, a total of the engine is downsized and dimensions in the radial direction and the axial direction needs not to magnify.

BRIEF DESCRIPTION OF THE DRAWINGS

FIGS. 3A and 3B are sectional views taken along a line III—III of FIG. 1 showing an embodiment of a clutch mechanism used in the invention in which FIG. 3A is a view showing a state before starting a self-motor and FIG. 3B is a view showing a state after starting the self-motor;

DETAILED DESCRIPTION OF PREFERRED EMBODIMENTS

Figure 1:
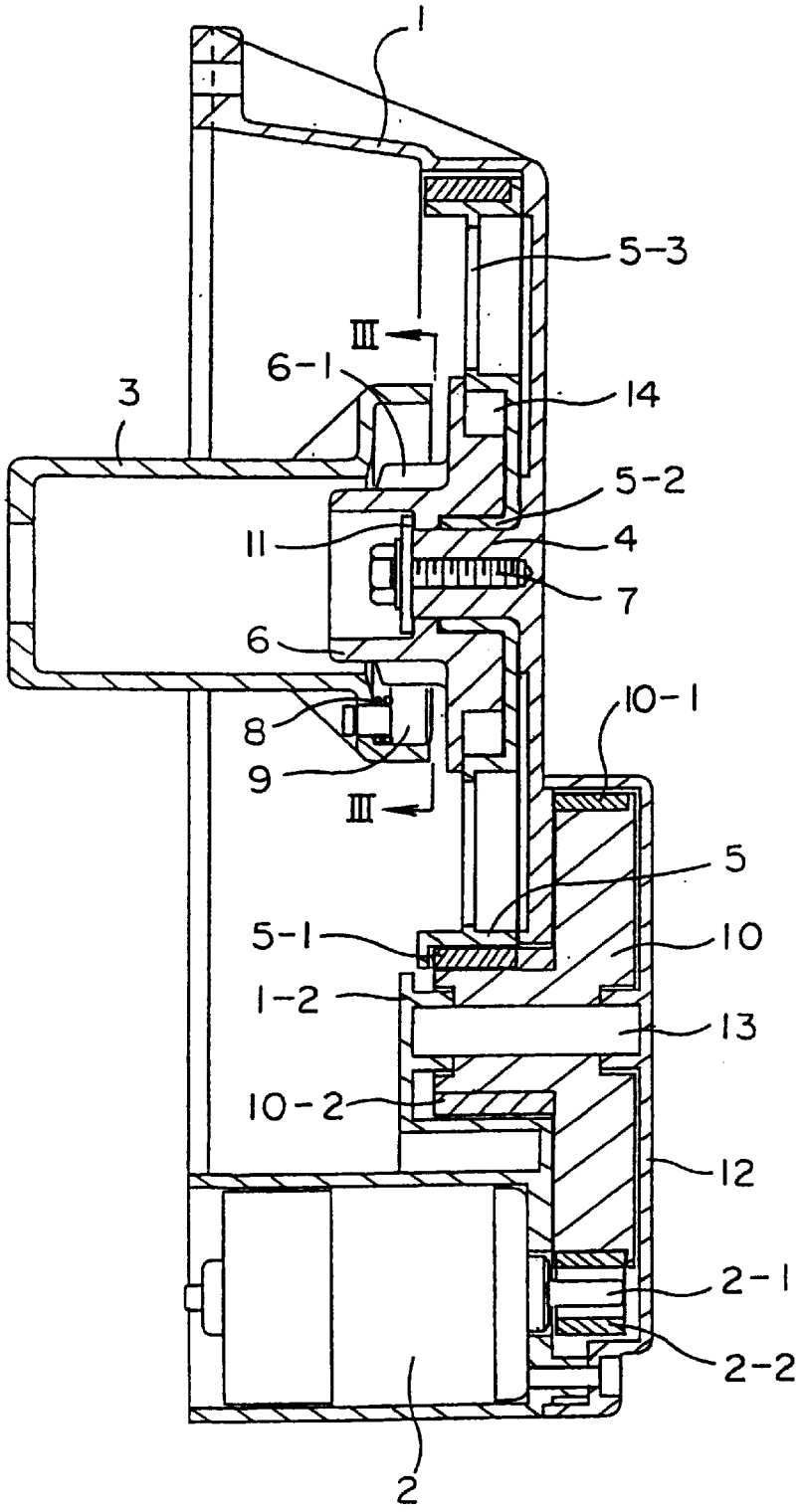
FIG. 1 is an explanatory view showing a vertical section of an embodiment of a starting device for an electric starter motor according to the invention.

In the drawings, numeral 1 designates a starter case, numeral 2 designates a small-sized motor for a starter (self-motor), numeral 3 designates a pulley attached to a crank shaft, numeral 4 designates a shaft portion projected from substantially the center of the starter case, numeral 5 designates a ring gear installed rotatably to the shaft portion 4, numeral 6 designates a cam cylinder attached to the shaft portion 4 by a fastening screw 7 for rotating along with the ring gear 5, numeral 8 designates return springs, numeral 9 designates ratchets installed rotatably to the pully 5 and free ends of which are urged inwardly in a radial direction by the return springs 8 and numeral 10 designates a reduction gear interposed between the small-sized motors 2 and the ring gear 5.

Figure 2:
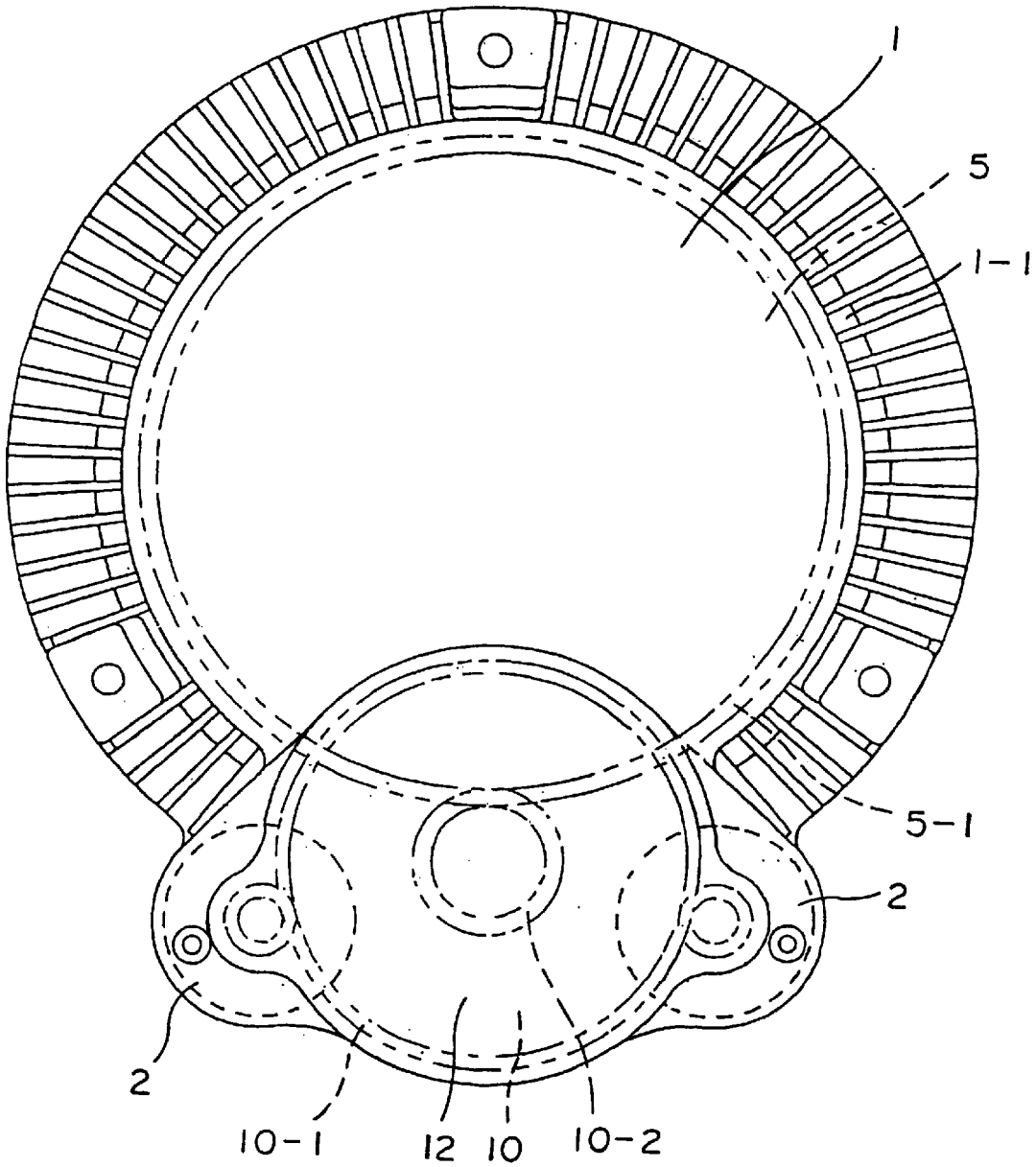
FIG. 2 is a front view of FIG. 1.
Figure 3:
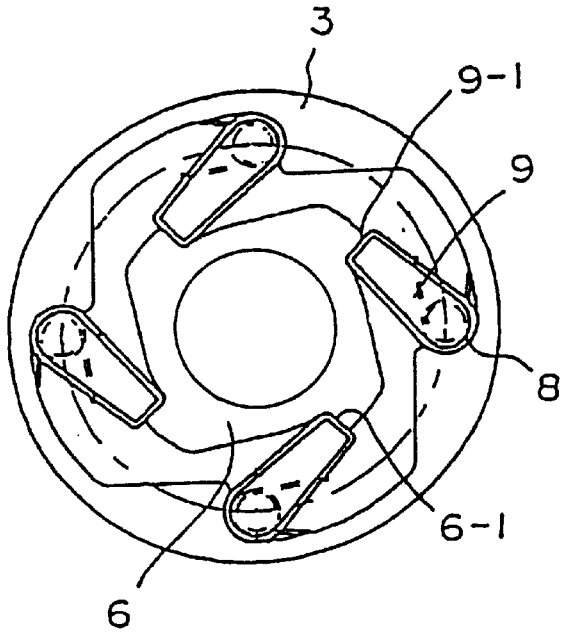
Figure 3:
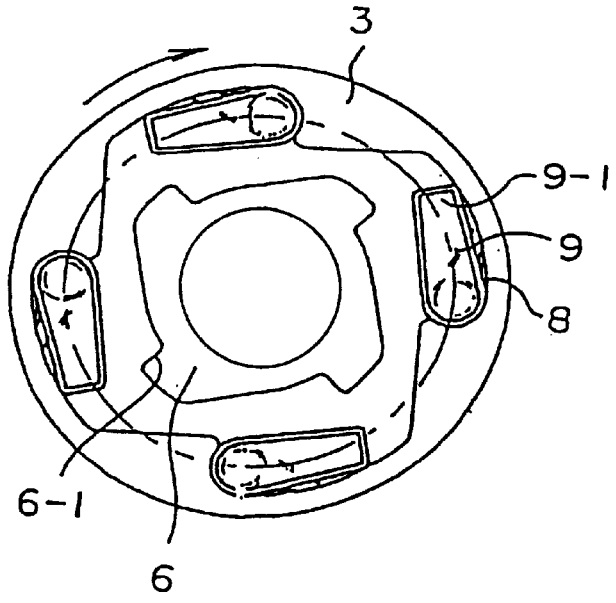

An explanation will firstly be given of an embodiment shown by FIG. 1 through FIG. 3. A plurality (two in the illustrated embodiment) of the small-sized motors 2 for the starter are attached in the axial direction at inside of the starter case 1 having ventilation windows 1-1. A gear portion 2-2 is fixed to a drive shaft 2-1 of the motor 2 and the gear portion 2-2 is rotated by the motor 2. The reason for using and installing the plurality of motors 2 for a starter which are small-sized as in micro motors in this invention, resides in that in comparison with the case in which the conventional large-sized motor is used, not only dimensions in the radial direction and the axial direction of the apparatus can be reduced as a whole but also in comparison with the conventional large-sized motor, the price becomes inexpensive as a whole even when the plurality of them are installed.

Further, the plurality of motors 2 can be constituted to operate simultaneously or successively operate at certain time intervals.

Meanwhile, on the inner side of the starter case 1, the shaft portion 4 is projected in the axial direction integrally with the starter case. A gear portion 5-1 is provided at the outer periphery of the ring gear 5 which is installed rotatably at a cylindrical portion 5-2 thereof fitted to the shaft portion 4. Further, the cam cylinder 6 having a plurality of cam portions 6-1 is attached to an outer peripheral portion of a front end of the shaft portion 4 by the fastening screw 7 via a washer 11.

Further, a plurality of the ratchets 9 free ends 9-1 (refer to FIGS. 3A and 3B) of which are urged inwardly in the radial direction by the return springs 8, are pivotably attached to an outer peripheral portion of the pulley 3 attached to a crank shaft (not illustrated) in correspondence with the cam portions 6-1.

Further, the reduction gear 10 is arranged on a side of an outer face of the starter case 1, is disposed such that an outer peripheral gear portion 10-1 having a large diameter of the reduction gear is placed on the outer side and an inner peripheral gear portion 10-2 having a small diameter is placed on the inner side and is installed rotatably at a shaft portion 13 provided between a reduction gear case 12 attached to an outer face of the starter case 1 and a bearing portion 1-2 projected from a side wall of the starter case 1.

Further, the outer peripheral gear portion 10-1 having a large diameter of the reduction gear 10 is constituted to be brought in mesh with the gear portions 2-2 fixed to the drive shafts 2-1 of the small-sized motors 2 and the inner peripheral gear portion 10-2 having a small diameter is constituted to be brought in mesh with the gear portion 5-1 at the outer periphery of the ring gear 5.

Further, numeral 14 designates a damper interposed between the cam cylinder 6 and the ring gear 5 to promote the durability of the small-sized motors by preventing impact in engagement or detachment of the ratchets 9 and the cam cylinder 6 from being directly transmitted from the small-sized motors 2 via the ring gear 5 and the reduction gear 10. Further, notation 5-3 designates ventilation windows attached to the ring gear 5 for promoting an effect of cooling the engine by delivering cooling wind introduced from the ventilation windows 1-1 of the starter case 1 to the side of the engine via the ventilation windows 5-3.

Next, an explanation will be given of the operation of the invention having such a constitution. When the plurality of small-sized motors 2 are started by power supply from a battery via a control apparatus (not illustrated), the drive shafts 2-1 are rotated and the reduction gear 10 is rotated by the outer peripheral gear portion 10-1 in mesh with the gear portions 2-2. By rotating the reduction gear, the ring gear 5 is rotated by the outer peripheral gear portion 5-1 in mesh with the inner peripheral gear portion 10-2 and rotation of the small-sized motors 2 is decelerated by the reduction gear 10 and transmitted to the ring gear 5.

Further, by rotating the ring gear 5, the cam cylinder 6 is also rotated integrally, the rotation of the motors 2 is transmitted to the pulley 3 by the free ends 9-1 urged inwardly by the return springs 8 and disposed at positions shown by FIG. 3A to engage with the cam portions 6-1 of the cam cylinder 6 via the ratchets 9 and as a result, the engine is started.

When the engine is started and the pulley 3 is rotated at high speed, large centrifugal force is exerted on the ratchets 9 pivotably attached to the pulley 3, the free ends 9-1 of the ratchets 9 are expanded to open outwardly in the radial direction against the return springs 8 and therefore, the connection between the ratchets 9 and the cam cylinder 6 is disconnected and during the rotation of the engine, the centrifugal force continues to exert on the ratchets to maintain positions thereof shown by FIG. 3B.

Meanwhile, when the engine is cut, the rotation of the pulley 3 is reduced and the free ends 9-1 of the ratchets 9 are directed inwardly in the radial direction by operation of the return springs 8. However, the rotational direction of the pulley 3 is directed in an arrow mark direction of FIG. 3B and accordingly, the free ends 9-1 are rotated while riding over the cam portions 6-1 of the cam cylinder 6 and the free ends 9-1 are not stopped abruptly by being brought into contact with the cam portions 6-1. Further, when the engine is stopped, the ratchets 9 occupy the positions shown by FIG. 3A.

Figure 4:
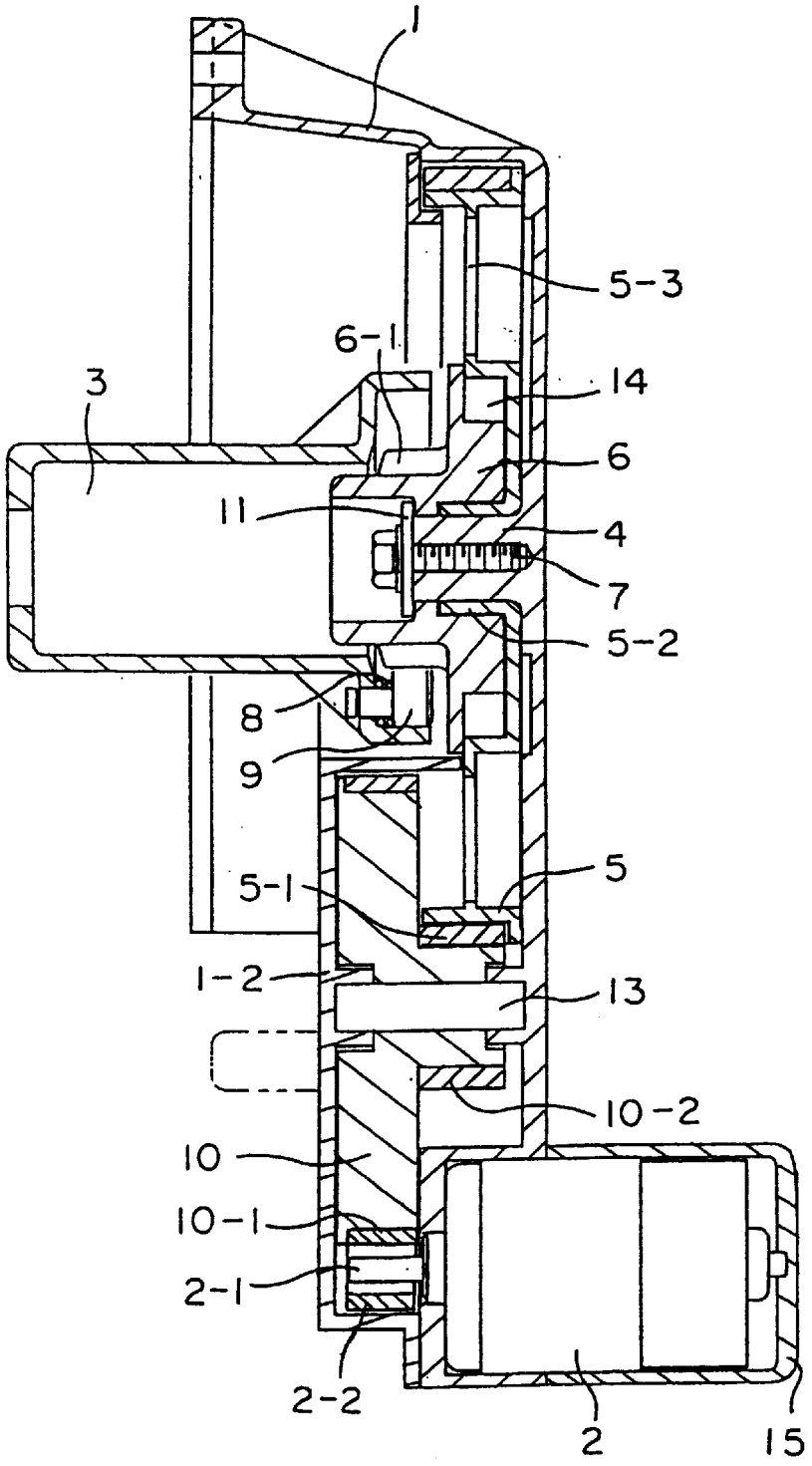
FIG. 4 is an explanatory view showing a vertical section of other embodiment of a starting device for an electric starter motor according to the invention.
Figure 5:
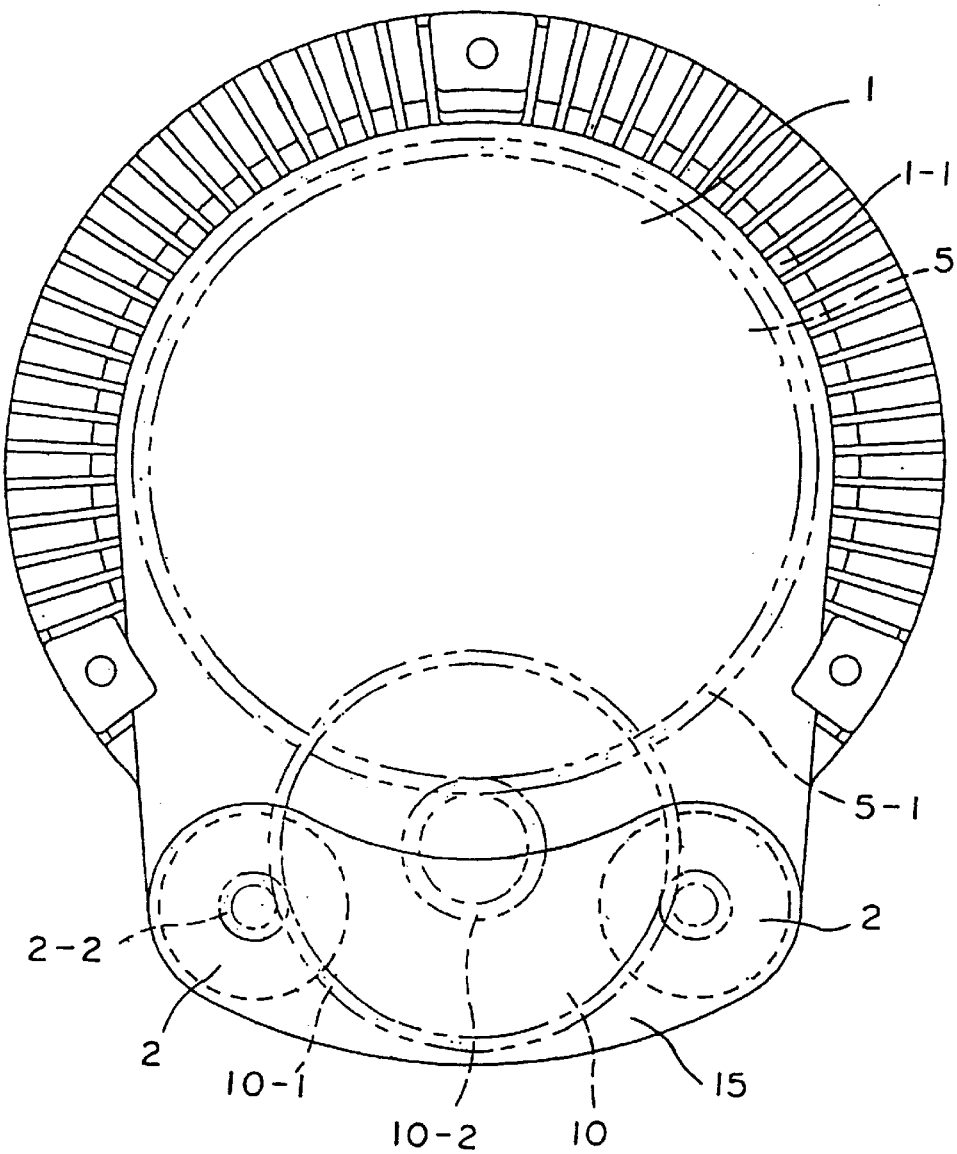
FIG. 5 is a front view of FIG. 4.

Although an explanation has been given of the embodiment in which the reduction gear 10 is arranged on the side of the outer face of the starter case 1 and the small-sized motors 2 are installed at inside of the starter case, the invention is not limited to the embodiment but can also be constituted as shown by FIG. 4 and FIG. 5.

That is, according to an embodiment shown by FIG. 4 and FIG. 5, the small-sized motors 2 are attached to the starter case 1 by a small-sized motor case 15 to project from the outer face of the starter case 1 in the axial direction and are arranged to dispose the outer peripheral gear portion 10-1 having a large diameter on the inner side and the inner peripheral gear portion 10-2 having a small diameter on the outer side such that the reduction gear 10 is directed in a direction opposed to the direction of the above-described embodiment.

Further, similar to the above-described embodiment, the gear portions 2-2 fixed to the drive shafts 2-1 of the small-sized motors 2 are brought in mesh with the outer peripheral gear portion 10-1 having a large diameter and the outer peripheral gear portion 5-1 of the ring gear 5 is brought in mesh with the inner peripheral gear portion 10-2 having a small diameter.

Further, other constitution and operation of this embodiment are the same as those in the embodiment shown by FIG. 1 through FIG. 3 and accordingly, an explanation thereof will be omitted and either of the constitutions can pertinently be selected and used in view of the attachment pitch of the starter case, incorporated parts and so on.

As described above, according to the invention, by the deceleration by gears, the small-sized motor per se can be downsized without increasing the torque of the small-sized motor and there can be provided the starting device for an electric starter motor capable of being fabricated in a small size as a whole and inexpensively and capable of setting a reduction gear having desired dimensions without significantly changing sizes in the radial direction and in the axial direction of a total of the starter case.

What is claimed is:

1. A starting device for an electric starter motor comprising:

a ring gear driven by at least two small-sized motors;

a clutch mechanism installed between the ring gear and an engine for starting the engine by rotating the ring gear; and a reduction gear interposed between the at least two small-sized motors and the ring gear;

wherein the reduction gear is installed on a side of an outer face of a starter case and the at least two small-sized motors are installed at inner portions of the starter case.

2. The starting device of claim 1 wherein the reduction gear is installed rotatably at a shaft portion provided between a reduction gear case attached to an outer face of the starter case and a bearing portion projecting from a side wall of the starter case such that an outer peripheral gear portion thereof having a large diameter is disposed on an outer side and an inner peripheral gear portion thereof having a small diameter is disposed on an inner side.

3. A starting device for an electric starter motor comprising:

a ring gear driven by at least two small-sized motors;

a clutch mechanism installed between the ring gear and an engine for starting the engine by rotating the ring gear; and a reduction gear interposed between the at least two small-sized motors and the ring gear;

wherein the at least two small-sized motors are installed on a side of an outer face of a starter case and the reduction gear is installed at an inner portion of the starter case;

and wherein the reduction gear is installed rotatably at a shaft portion provided between a reduction gear case attached to an outer face of the starter case and a bearing portion projecting from a side wall of the starter case such that an outer peripheral gear portion thereof having a large diameter is disposed on an inner side and an inner peripheral gear portion thereof having a small diameter is disposed on an outer side.

4. A starting device for an electric starter motor comprising:

a ring gear driven by at least two small-sized motors;

a clutch mechanism installed between the ring gear and an engine for starting the engine by rotating the ring gear; and a reduction gear interposed between the at least two small-sized motors and the ring gear;

wherein said clutch mechanism has a pulley attached to a crank shaft, return springs installed at an outer peripheral portion of the pulley, ratchets having free ends which are urged inwardly in a diameter direction by the return springs, and cam portions attached to a shaft portion projecting from substantially a center of a starter case and installed at the outer periphery of a cam cylinder for rotating along with the ring gear, said cam portions being disengaged from the free ends of said ratchets by rotating the pulley at a high speed;

said reduction gear being installed on an outer face side of the starter case; and said at least two small-sized motors being installed within the starter case.

5. The starting device of claim 4, wherein the reduction gear is installed rotatably at a shaft portion provided between a reduction gear case attached to an outer face of the starter case and a bearing portion projecting from a side wall of the starter case such that an outer peripheral gear portion thereof having a large diameter is disposed on an outer side and an inner peripheral gear portion thereof having a small diameter is disposed on an inner side.

6. A starting device for an electric starter motors comprising:

a ring gear driven by at least two small-sized motors;

a clutch mechanism installed between the ring gear and an engine for starting the engine by rotating the ring gear; and a reduction gear interposed between the at least two small-sized motors and the ring gear;

wherein said clutch mechanism has a pulley attached to a crank shaft, return springs installed at an outer peripheral portion of the pulley, ratchets having free ends which are urged inwardly in a diameter direction by the return springs, and cam portions attached to a shaft portion projecting from substantially a center of a starter case and installed at the outer periphery of a cam cylinder for rotating along with the ring gear, said cam portions being disengaged from the free ends of said ratchets by rotating the pulley at high speed; and said a least two small-sized motors being installed on an outer face of said starter case and the reduction gear being installed at an inner portion of the starter case.

7. The starting device of claim 6, wherein the reduction gear is installed rotatably at a shaft portion provided between a reduction gear case attached to an outer face of the starter case and a bearing portion projecting from a side wall the starter case such that an outer peripheral gear portion thereof having a large diameter is disposed on an inner side and an inner peripheral gear portion thereof having a small diameter is disposed on an outer side.

* * * * *

UNITED STATES PATENT AND TRADEMARK OFFICE

CERTIFICATE OF CORRECTION

PATENT NO. : 6,272,940 B1
DATED : August 14, 2001
INVENTOR(S) : Shuhei Tsunoda et al.

It is certified that error appears in the above-identified patent and that said Letters Patent is hereby corrected as shown below:

Column 6, claim 6,
Line 23, "motors" should read -- motor --.

Column 6, claim 7,
Line 49, after "wall" insert -- of --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*